US011312912B2

(12) United States Patent
Koseoglu

(10) Patent No.: US 11,312,912 B2
(45) Date of Patent: Apr. 26, 2022

(54) HYDROGEN-ENHANCED DELAYED COKING PROCESS

(71) Applicant: SAUDI ARABIAN OIL COMPANY, Dhahran (SA)

(72) Inventor: Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 110 days.

(21) Appl. No.: 16/885,157

(22) Filed: May 27, 2020

(65) Prior Publication Data

US 2020/0377797 A1 Dec. 3, 2020

Related U.S. Application Data

(60) Provisional application No. 62/853,790, filed on May 29, 2019.

(51) Int. Cl.
*C10G 9/00* (2006.01)
*C10B 55/00* (2006.01)
(Continued)

(52) U.S. Cl.
CPC ..... *C10G 9/005* (2013.01); *C10B 55/00* (2013.01); *C10B 57/06* (2013.01); *C10B 57/14* (2013.01)

(58) Field of Classification Search
CPC ..... C10G 9/005; C10B 55/00; C10B 57/06
See application file for complete search history.

(56) References Cited

U.S. PATENT DOCUMENTS 2,888,393 A 5/1959 Ballard et al.
2,888,395 A 5/1959 Henny
(Continued)

FOREIGN PATENT DOCUMENTS

CN 1676574 A 10/2005
CN 1676573 A 6/2007
(Continued)

OTHER PUBLICATIONS

International Search Report and Written Opinion dated Sep. 16, 2020 in corresponding International Application PCT/US2020/034752.

*Primary Examiner* — Renee Robinson
(74) *Attorney, Agent, or Firm* — Leason Ellis LLP

(57) ABSTRACT

A method is described for treating a hydrocarbon oil feedstream to a delayed coking unit to maximize the ratio of the yield of liquids-to-gases, and to minimize the formation of coke which includes:

a. mixing an oil-soluble catalyst with the hydrocarbon oil feedstream to produce a uniform mixture;
b. contacting the catalyst-containing hydrocarbon oil feedstream with an excess of hydrogen under predetermined conditions that are favorable to maximizing the solubility of the hydrogen in the feedstream in a hydrogen distribution zone that is upstream of the coking unit;
c. introducing the feedstream containing the solubilized catalyst and dissolved hydrogen, and the excess hydrogen gas into a flashing zone;
d. recovering from the flashing zone a hydrogen gas stream and a single-phase hydrocarbon oil feedstream containing dissolved hydrogen and catalyst;
e. maintaining the hydrocarbon oil feedstream containing dissolved hydrogen and catalyst under single-phase conditions to promote the reaction of the dissolved hydrogen with free radicals formed in the feedstream and to promote the catalyzed hydrodesulfurization of any sulfur-containing compounds present in the feedstream;
f. introducing the catalyst-containing feedstream into a coking furnace upstream of the coking unit to heat the feedstream to a predetermined coking temperature;
(Continued)

g. introducing the hot feedstream into the coking unit; and
h. recovering a coking unit product stream that is free of catalyst and forming a coke product that contains the catalyst.

23 Claims, 2 Drawing Sheets

(51) Int. Cl.
*C10B 57/06* (2006.01)
*C10B 57/14* (2006.01)

(56) References Cited

U.S. PATENT DOCUMENTS

| | | | |
|---|---|---|---|
| 4,312,742 | A | 1/1982 | Hayashi |
| 4,358,366 | A | 11/1982 | Alford et al. |
| 4,394,250 | A | 7/1983 | Grossberg |
| 4,661,241 | A | 4/1987 | Dabkowski et al. |
| 4,797,197 | A | 1/1989 | Mallari |
| 4,919,793 | A | 4/1990 | Mallari |
| 5,711,870 | A | 1/1998 | Storm et al. |
| 2012/0298552 | A1 | 11/2012 | Koseoglu |
| 2014/0054199 | A1 | 2/2014 | Koseoglu |

FOREIGN PATENT DOCUMENTS

| | | | |
|---|---|---|---|
| CN | 105985796 | A | 10/2016 |
| GB | 2138017 | A | 10/1984 |
| WO | 2006/102534 | A2 | 9/2006 |

HYDROGEN-ENHANCED DELAYED COKING PROCESS

This application claims priority to U.S. Provisional Patent Application No. 62/853,790 filed May 29, 2019, the contents of which are incorporated herein by reference in its entirety.

FIELD OF THE INVENTION

This invention relates to the delayed coking process for treating heavy hydrocarbon oils.

BACKGROUND OF THE INVENTION

Delayed coking has been practiced for many years. The process utilizes thermal decomposition of heavy liquid hydrocarbons to produce coke, gas and liquid product streams of varying boiling ranges. The resulting coke is generally treated as a low value by-product, but is recovered for various uses, depending upon its quality.

The use of heavy crude oils having high metals and sulfur content is increasing in many refineries, and delayed coking operations are of increasing importance to refiners. The increasing concern for minimizing air pollution is a further incentive for treating residuum in a delayed coking unit since the gases and liquids produced contain sulfur in a form that can be relatively easily removed.

Coking is a carbon rejection process in which low-value atmospheric or vacuum distillation bottoms are converted to lighter products which in turn can be hydrotreated and upgraded to produce transportation fuels, such as gasoline and diesel. During the coking process, the heavy molecules are cracked to form light products and some of the heavy free radical-containing molecules combine to form heavier polynuclear aromatic compounds, i.e., coke. Coking of residuum from heavy high sulfur content, or sour, crude oils is carried out primarily as a means of utilizing such low value hydrocarbon streams by converting part of the material by carbon rejection to more valuable liquid and gas products.

In the commercial practice of the delayed coking process, the feedstock is first introduced into a fractionating column where lighter materials are recovered from the top and the bottoms are then sent to a coking furnace where they are rapidly heated to a coking temperature in the range of 480° to 530° C. and then fed to the coking drum. Coking units are typically configured with two parallel drums and operated in a swing mode. When one of the drums is filled with coke, the feed is transferred to the empty parallel drum. Liquid and gas streams from the coking drum are fed to the coking unit product stream fractionator.

Any hydrocarbon vapors remaining in the coking drum are removed by steam injection. The coke is cooled with water and then removed from the coking drum using hydraulic and/or mechanical means.

In the delayed coking unit production of fuel grade coke and, to some extent, even in the production of anode or aluminum grade coke, it is desirable to minimize the coke yield and maximize the liquid product yield, since the liquids are more valuable than the coke. It is also desirable to produce a coke having a volatile matter content of not more than about 15 percent by weight, and preferably in the range of 6 to 12 percent by weight.

In the conventional delayed coking process, fresh feedstock is introduced into the lower part of the coking unit product stream fractionator and the fractionator bottoms, which include the heavy recycle material, and the fresh feedstock are heated to coking temperature in a coking furnace. The hot mixed fresh and recycle feedstream is introduced into a coking drum maintained at coking conditions of temperature and pressure where the feed decomposes or cracks to form coke and volatile components. The volatile components are recovered as vapor and transferred to the coking unit product fractionator. Heavy gas oil from the fractionator is added to the flash zone of the fractionator to condense the heaviest components from the coking unit product vapors. The heaviest fraction of the coking drum vapors can be condensed by other techniques, such as heat exchange, but in commercial operations it is common to contact the incoming vapors with heavy gas oil in the coking unit product fractionator. Conventional heavy recycle oil is comprised of condensed coking unit product vapors and unflashed heavy gas oil. When the coking drum is full of coke, the feed is switched to another drum, and the full drum is cooled and emptied by conventional methods as described above.

It is also known to add a catalyst to the fresh feed and/or the fresh and recycle oil mixture prior to heating the feedstream in the coking unit furnace. The catalyst is used to promote the cracking of the heavy hydrocarbon compounds and the formation of the more valuable liquids that can be subjected to hydrotreating processes downstream to form transportation fuels. The catalyst remains in the coking unit drum with the coke that is formed.

The thermal cracking and carbon rejection processes that characterize delayed coking of heavy residuum feedstocks result in the rapid and generally uncontrolled breakdown of the hydrocarbon chains. The nature of the process leads to the production of lighter, shorter chain gaseous products in the coking unit product stream, which are generally deemed to be less preferred than the longer chain liquid products. It would therefore be desirable to provide an improvement to the process that will minimize light gas production and maximize the production of liquids in the coking unit which thereafter can be subjected to hydrotreating processes to produce transportation fuels.

It is to be understood that the terms "coking unit product stream" and "coking unit product" are used interchangeably in this disclosure, as are the terms "coking unit" and "coker".

SUMMARY OF THE INVENTION

In accordance with the process of the present disclosure, an oil soluble homogeneous catalyst is added to, and uniformly mixed with the hydrocarbon oil feedstream to a delayed coking unit and thereafter the catalyst-containing feedstream mixture is contacted with an excess of hydrogen in an apparatus that promotes the saturation of the liquid mixture with the hydrogen. The excess hydrogen is subsequently flashed from the saturated mixture and recovered for recycling. The hydrogen-enriched catalyst-containing feedstream is then passed to the delayed coking unit.

The catalyst-containing feedstream when saturated with dissolved hydrogen and processed in the delayed coking unit enjoys the synergistic effect with the catalyst functioning to stabilize the free radicals formed and to reverse or retard the polymerization reactions that would otherwise occur at the coking temperature. In turn, the hydrogen reacts with the free radicals generated by the thermal cracking of the high molecular weight, long chain hydrocarbon compounds. The catalyst enhances and facilitates the reaction of the hydrogen in capping or terminating the free radicals, and thereby inhibit the formation of heavier polynuclear compounds. Where the feedstream contains sulfur compounds, the hydrogen present in the feedstream will take part in hydrodesulfurization reactions, further improving the quality of the coking unit product stream. The catalyst also functions to promote the desulfurization reactions. The catalyst and hydrogen thus work synergistically in the process to improve the proportion of desirable hydrocarbons in the coking unit product stream.

In accordance with the present disclosure, a coking unit product stream is obtained that provides a greater yield of quality distillates as compared to processing the same feedstream without the dissolved hydrogen.

In an alternative embodiment of the invention, an excess of hydrogen is added to saturate the feedstream, but no catalyst is added. When the feedstream is heated, the oil is thermally cracked and free radicals are formed. Even in the absence of a catalyst, the present hydrogen reacts to stabilize the free radicals formed and to thereby reduce the formation of large polymers, as well as reducing the initiation of undesirable side reactions at the coking temperature.

The process of the invention broadly comprehends treating a hydrocarbon oil feedstream to a delayed coking unit to maximize the ratio of the yield of liquids-to-gases and to minimize the formation of coke, the method being characterized by the following steps:

a. mixing an effective amount of an oil-soluble catalyst with the hydrocarbon oil feedstream to produce a uniform mixture;

b. contacting the catalyst-containing feedstream with an excess of hydrogen under predetermined conditions of temperature and pressure that are favorable to maximizing the solubility of the hydrogen in the feedstream;

c. introducing the feedstream containing the solubilized catalyst and dissolved hydrogen, and the excess hydrogen gas into a flashing zone;

d. recovering from the flashing zone a hydrogen gas stream and a single-phase hydrocarbon oil feedstream containing dissolved hydrogen and catalyst;

e. maintaining the feedstream under conditions of temperature and pressure to maximize the single-phase conditions under which the catalyst promotes the reaction of the dissolved hydrogen with free radicals formed in the feedstream;

f. introducing the catalyst-containing feedstream, hydrogenated reaction products and any remaining dissolved hydrogen into a furnace upstream of the coking unit to heat the feed stream to a predetermined coking temperature;

g. introducing the hot feedstream into the coking unit; and h. forming a coke product that contains the catalyst and recovering a coking unit product stream that is free of catalyst.

In an alternative embodiment, the solubility of hydrogen in hydrocarbon oil feedstream at the pressure and temperature conditions prevailing in the system is predetermined, e.g., by laboratory testing, and the amount of hydrogen provided is limited to that which will remain in solution in the hydrocarbon oil feedstream. In this embodiment, the flashing zone or flashing vessel and flashing step can be eliminated from the system and process as described above.

In an embodiment, the amount of soluble catalyst added to the feedstream is predetermined to maximize its effect, e.g., by laboratory testing of the particular feedstream, in promoting the cracking of heavier hydrocarbon compounds.

BRIEF DESCRIPTION OF THE DRAWINGS

The invention will be described in further detail below and with reference to the attached drawings in which the same or similar elements are identified by the same numeral, and where.

DETAILED DESCRIPTION OF THE INVENTION

Figure 1:
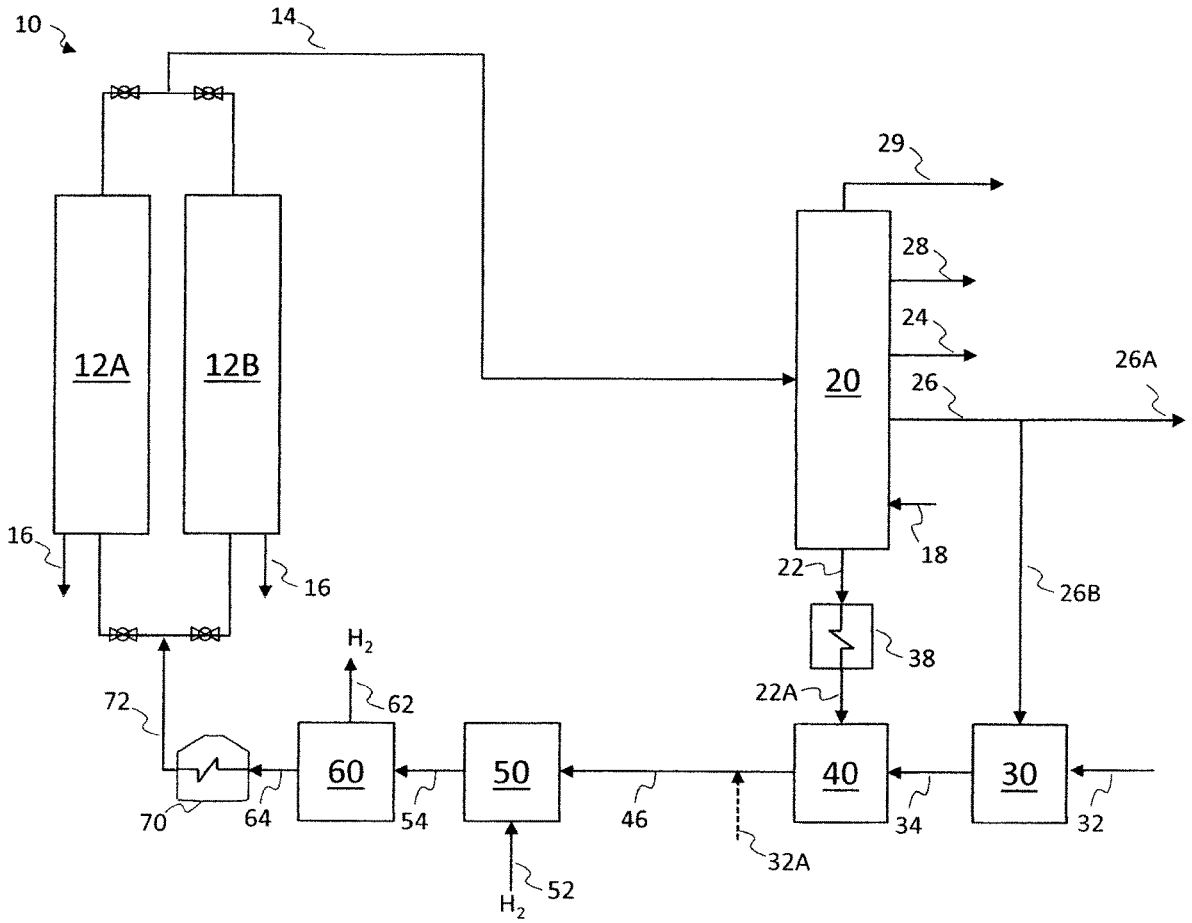
FIG. 1 is a schematic illustration of an embodiment that is suitable for the practice of the process of the present invention in which the feedstream undergoes an initial pre-treatment in a fractionator.

Referring now to FIG. 1, there is schematically illustrated a process for the practice of the invention in a delayed coking unit 10 that includes one drum, but preferably, as shown, with at least two drums (12A, 12B). The coking unit produces a delayed coking unit product stream (14) and a coke product (16) that is initially retained in the drum and subsequently removed by conventional means. The coking unit product stream (14) is introduced into a coking unit product fractionator (20) to produce at least a bottoms fraction (22), intermediate fractions (24, 26) and light fractions (28-29).

A hydrocarbon feedstock (18) containing undesirable sulfur and/or nitrogen compounds can in a preferred embodiment be introduced into the lower portion of the coking unit product fractionator (20) for preheating and to remove and recover light fraction stream (29) containing any light components that are present in the feedstream (18) and thereby avoid their eventual introduction into the coking unit and passing with the coking unit product stream (14).

In an alternative embodiment, (not shown), the heavy feedstream (18) can be pretreated in a separate fractionator of conventional design to remove the light components which, as noted above, are preferably not introduced into the coking unit (10).

The process of the invention includes mixing a homogenous oil-soluble catalyst with the feedstream (18) or the heated mixture of fractionator bottoms (22), prior to its contact with hydrogen to provide a hydrogen-saturated solution. In the embodiment illustrated in FIG. 1, a portion (26B) of the intermediate fractions (24 or 26) which serve as a diluent and at least one homogenous oil-soluble catalyst (32) that promotes hydrodesulfurization of sulfur-containing compounds and hydrogen transfer reactions are introduced into a catalyst mixing zone (30) for a time sufficient to form a hot diluent oil/catalyst feedstream component (34).

In another alternative embodiment (not shown) the homogeneous catalyst is mixed with a diluent hydrocarbon oil that can include one or more product streams that are available in the refinery, such as vacuum gas oil, decant oil, cycle oil, light gas oil, and their mixtures.

The fractionator bottoms stream (22) is optionally heated by passage through a heat exchanger (38) to raise its temperature to the range of 300° to 400° C., and preferably to the range of 350° C. to 380° C. The heated stream (22A) is introduced into a feedstream/catalyst mixing zone (40) where it is mixed with the hot diluent oil/catalyst stream component (34) from catalyst mixing zone (30).

In an alternative embodiment that is also depicted as an option in FIG. 1, the catalyst mixing zone (30) and feed mixing zone (40) are eliminated and the catalyst stream (32A), shown in phantom, is introduced directly into the heated feedstream (22A). Intimate mixing of the catalyst with the feedstream can be accomplished by the use of inline mixers, injectors, or other known turbulence-creating devices. As will be understood by those of ordinary skill in the art, the degree of mixing and time allotted to achieve complete, or substantially complete solubility of the catalyst will depend upon the type and nature of the catalyst introduced through this line (32A), as well as other physical conditions, such as its temperature.

The feedstream containing the catalyst is then contacted with hydrogen gas (52) that is introduced under pressure in a hydrogen distribution zone (50) to saturate the catalyst-containing feedstream (46) with dissolved hydrogen. The molar ratio of the hydrogen gas (52) to the hydrocarbon oil in the feedstream (46) is predetermined to provide either an excess of undissolved hydrogen or an amount that will be fully dissolved in the hydrocarbon oil/catalyst mixture (46) as was described above.

The hot feedstream (54) containing the catalyst, dissolved hydrogen and the excess hydrogen (if present) is sent to a flashing zone (60) to recover the excess hydrogen gas. The excess hydrogen gas stream (62) is recovered and recycled to the hydrogen distribution zone (50). The feedstream oil (64) containing dissolved hydrogen and solubilized homogeneous catalyst (32) is sent to the coking unit furnace (70) where it is heated to the desired coking temperature which can be in the range of 425° to 650° C. The heated feedstream (72) passes from the coking unit furnace (70) to one of the delayed coking unit drums (12A or 12B).

As shown in FIG. 1, the delayed coking unit is of typical design with two parallel drums (12A and 12B) that are operated in swing mode. When the operating drum is filled with coke product (16), the heated feedstream (72) is switched to the parallel drum for continuous operation of the unit (10), while the coke product (16) is removed from the first drum by conventional means.

Liquid and gas coking unit product stream (14) is preferably passed to a liquid/gas separator (not shown) to remove the lighter products, and the remaining liquid coking unit product stream is introduced into coking unit product stream fractionator (20). The coking unit product stream (14) is fractionated to yield separate product streams that can include naphtha stream (28), gas oil stream (24) and heavy gas oil stream (26), each of which are recovered from the fractionator. The heavy gas oil stream (26) is split in accordance with the embodiment of FIG. 1 into a recovered stream (26A) and a portion (26B) that is used as the diluent oil that is mixed with the catalyst (32) in the mixing zone (30).

Figure 2:
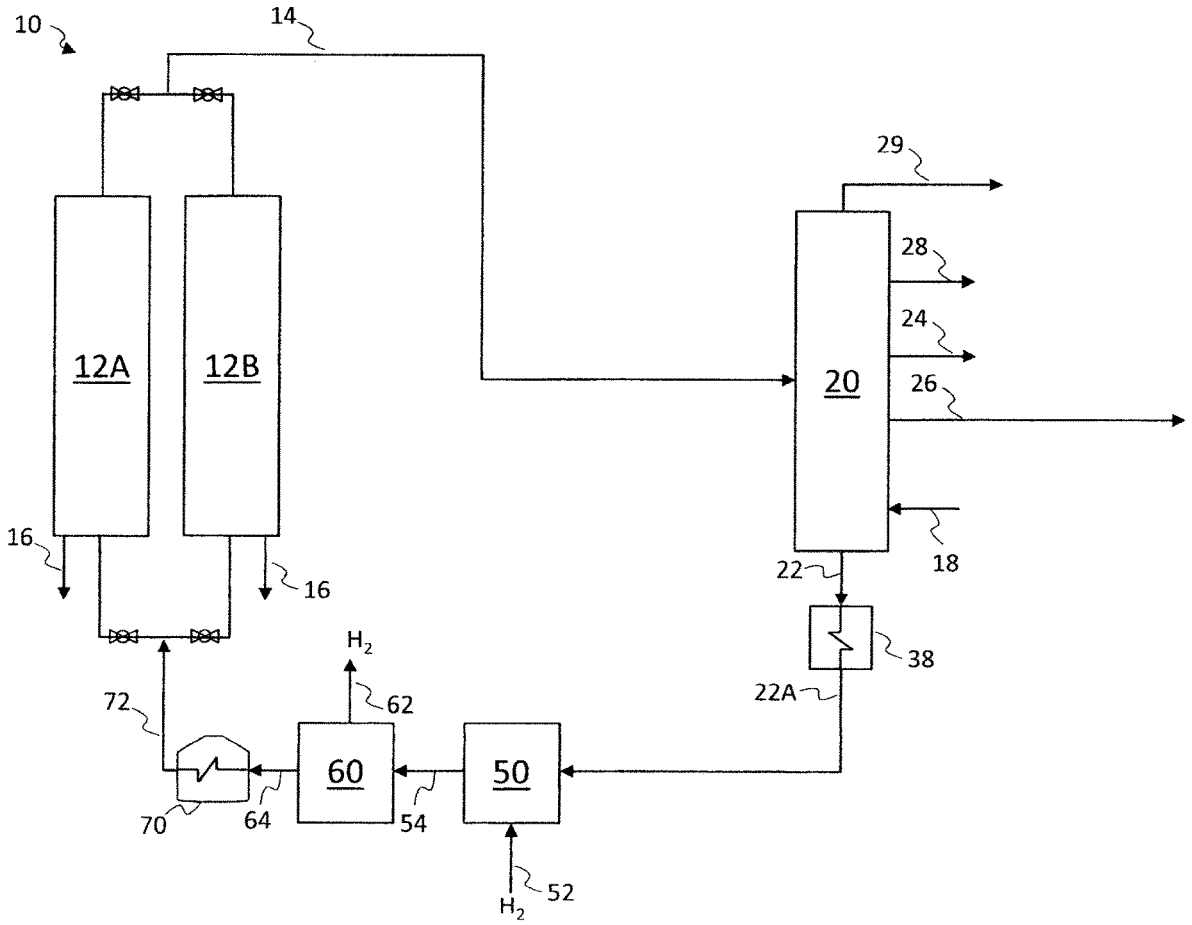
FIG. 2 is a schematic diagram of another embodiment for the practice of the process.

Referring now to FIG. 2, a second embodiment is schematically illustrated in which the delayed coking process is enhanced with hydrogen dissolved in the coking unit feedstream in the absence of any catalyst. The process is similar to that described above with reference to FIG. 1, with the principal exception being that the diluent/catalyst mixing zone (30) and the catalyst/feedstream mixing zone (40) are by-passed or eliminated entirely. In this embodiment, the heated bottoms (22A) from the fractionator (20) are passed directly to the hydrogen distribution zone (50). The hydrogen stream (52) under predetermined conditions of pressure and temperature is introduced into the apparatus positioned inside of the distribution zone (50) for discharge in intimate and turbulent contact with the liquid feedstream (22A). The conditions in the hydrogen distribution zone (50) assure saturation of the liquid feedstream which is thereafter discharged from the distribution zone and passed as saturated feedstream (54) to the flashing zone (60) for recovery of the excess hydrogen gas as stream (62). The remainder of the apparatus and its method of operation are substantially the same as that previously described and will not be repeated here.

In both embodiments, the hydrogen reacts with free radicals that are created by the thermal cracking of the hot hydrocarbon feedstream in the drum of delayed coking unit, thereby preventing or reducing the occurrence of undesirable side reactions. If the catalyst is present, as in the embodiment described in conjunction with FIG. 1, the hydrogen participates in a hydrodesulfurization reaction, which further improves the quality of the coking unit product stream (14).

The heavy hydrocarbon oil feedstock (18) is preferably derived from natural sources that can include crude oil, bitumen, tar sands and shale oils, refinery residuum such as atmospheric and vacuum distillation bottoms, heavy oil coking unit products and visbreaker and fluid catalytic cracking bottoms. The feedstock can have a boiling point in the range 36° to 2000° C.

The hydrogen gas can be dissolved in the coking unit feedstream by any convenient apparatus and methods which provide for the intimate and efficient contact between a gas and a liquid. As previously noted, hydrogen is generally more soluble in the lighter hydrocarbons that are preferably used as a diluent for the catalyst. It can therefore be advantageous to contact the hydrogen and diluent hydrocarbon oil under physical conditions that are favorable to the absorption of the hydrogen. The heavier hydrocarbon feedstock can be added to the catalyst and diluent oil mixture while the addition of hydrogen is continued until the mixed solution is saturated with hydrogen. It certain embodiments the diluent oil containing the catalyst are be contacted with an excess of hydrogen before the catalyst and diluent oil are added to the hydrocarbon oil feedstream. The temperature and pressure of the gas and liquids in the hydrogen distribution mixing vessel (50) is controlled to optimize the absorption of hydrogen. The optimum parameters can be predetermined by routine tests performed on a sample of the feedstream prior to initiation of the process, or during continuous operations when a change of feedstream occurs.

Gas distribution devices known in the chemical processing art and unit operations field that can be used include those that are configured as a mixing column or vessel, positioned horizontally or vertically, in which a plurality of generally planar manifolds are secured in axially spaced-apart relation. A source of pressurized hydrogen is connected through an external fitting and valve to each of the individual manifolds. The manifolds can be fitted with spaced-apart nozzles and/or jets, or the manifolds can be provided with orifices through which the pressurized hydrogen is discharged.

The liquid hydrocarbon feed is admitted via a conduit and flows through the vessel. A screen, baffles or other mechanical means can be provided upstream of the first hydrogen distribution manifold to assure a liquid flow pattern that will bring the entire volume of the hydrocarbon feed entering the vessel into maximum contact with the hydrogen gas discharged from the gas outlets of the spaced-apart manifolds.

The hydrogen distribution manifolds in the mixing vessel can be of the same or of different configurations. For example, a manifold can be formed from a plurality of parallel, spaced-apart tubes connected to one or more intersecting tubes, all of which are provided with spaced-apart nozzles, jets and/or orifices to assure a uniform distribution of hydrogen. The manifold is proportioned and configured to fit within the vessel, e.g., it is of generally circular shape if it is positioned in a circular column or vessel.

The manifold can be a single tube provided with nozzles, jets or orifices which are sufficient to discharge the pressurized hydrogen over the adjacent cross-sectional region inside the vessel through which the liquid hydrocarbon feed is passing. It will be understood that the gas discharged will create zones of turbulence that will promote absorption.

The manifold can also be configured as one or more annular rings which discharge the hydrogen toward the periphery of the vessel and/or towards the axis of flow of the liquid hydrocarbon feed. The circular manifold can be fitted with a plurality of radially extending tubes, and the entire assembly can also be provided with nozzles, jets and/or orifices for the discharge of the pressurized hydrogen.

A variety of other types of apparatus and methods for establishing intimate contact between a gas and liquid reactant are well known in the art. Examples of such apparatus and their modes of operation are described in the following representative U.S. Pat. Nos. 5,837,208; 3,378,349; 5,942,197; 5,484,578; 3,598,541; 3,880,961 and 5,158,714. The disclosures of these patents are incorporated herein by reference where permitted by the rules of practice in which this application may be examined.

The hydrogen pressure in the hydrogen distribution zone, which can be a column or other vessel, can be in the range of from 10-50 bar, and is preferably in the range of from 10-30 bar. The hydrogen volumetric flow rate can be in the range of from 10 to 5000 liters per liter of oil, and the volumetric ratio of hydrogen-to-oil is preferably from 300-to-1 to 1000-to-1.

The catalyst composition can comprise an organometallic compound or complex, with the metal component selected from the elements of IUPAC groups 4-12. The metal component is preferably selected from molybdenum, nickel, vanadium, iron and cobalt. The catalyst composition comprises at least one transition metal and at least one organic moiety comprising or derived from octanoic acid, 2-ethylhexanoic acid, naphthenic acid, pentacarbonyl or hexacarbonyl. The preferred catalyst compositions include at least one of molybdenum 2-ethylhexanoate, molybdenum naphthanate, molybdenum hexacarbonyl, vanadium octoate, vanadium naphthanate and iron pentacarbonyl. The metal component of the catalyst can be present at a concentration in the range of from 1 ppm to 5000 ppm by weight of the catalyst. The activated molecular catalyst comprises molybdenum disulfide after contacting a feedstream containing sulfur compounds.

The catalyst can be mixed with a diluent hydrocarbon oil prior to addition to the feedstream. The diluent oil can be at least one of vacuum gas oil, decant oil, a light or heavy cycle oil or light gas oil. Assuming that the diluent hydrocarbon oil is a lighter fraction or consists of lighter fractions than the coking unit feedstream, the hydrogen will be more soluble in this hydrocarbon oil. The diluent oil can have a boiling point in the range of 180° C. to 520° C. The ratio of the catalyst/diluent mixture-to-feedstream can be in the range of from 0.001:10 to 0.1:1. At the higher ratios, the diluent oil will also serve as a significant hydrogen carrier, since the solubility of hydrogen is higher in the lighter hydrocarbons than in the heavier feedstream.

The ratio of catalyst composition-to-hydrocarbon oil diluent can be in the range of from 1:500 to 1:1 by volume, is preferably in the range of from 1:150 to 1:2 v/v, and most preferably is in the range of 1:100 to 1:5 v/v.

The hydrocarbon oil diluent and catalyst composition can be mixed at temperatures in the range of from 25° C. to 250° C., the catalyst/diluent oil mixture and heavy oil feedstock can be mixed at a temperature in the range of from 25° C. to 350° C. The dissolved catalyst and diluent oil can be stored for use as needed after premixing as described. The catalyst-containing feedstock is heated to a temperature in a range of from 275° C. to 450° C. to form a molecular catalyst composition. To the extent that any of the catalyst particles remain undissolved, the composition can be described as colloidal, or as a slurry, if the number of catalyst particles remaining is significant.

The hydrocarbon oil diluent and catalyst composition is mixed for a time ranging from 20 seconds to approximately 3 minutes; the diluted catalyst mixture and heavy oil feedstock is mixed for a time ranging from 20 seconds to 5 minutes. Any suitable mixing vessel with a stirrer or other means of agitation can be utilized. The catalyst mixture can be introduced into the feedstream using an inline mixer, injectors and other devices and apparatus that are well known in the art. As will be apparent to one of ordinary skill in the art, the catalyst should be as uniformly distributed as possible in order to maximize the catalyzed reactions throughout the hydrocarbon feedstream.

The operating temperature of the coking drum can be in the range of from 425° to 650° C., is preferably from 425° to 540° C., is more preferably from 450 to 510° C., and most preferably is from 470° to 500° C. The operating pressure of the coking drum is mildly super-atmospheric and can be in the range of from 1 to 60 bar, and is preferably from 1 to 10 bar.

EXAMPLES

The following laboratory-scale examples demonstrate the benefit of dissolved hydrogen in the delayed coking of an atmospheric residue having the properties specified for the sample of Example 1. Note that Example 1 is a comparative example in which the atmospheric residue was processed without dissolved hydrogen.

Example 1

An atmospheric residue containing 84.73 W % of carbon, 11.79 W % of hydrogen 4.16 W % of sulfur and 11.79 W % of MCR having a density of 0.9726 Kg/L at 15° C. was subjected to delayed coking in an autoclave at 485° C. The atmospheric residue was placed in an autoclave and pressurized with nitrogen gas at 60 bars. The nitrogen is inert under these conditions. The autoclave was then purged at room temperature to remove any volatiles in the vessel and then heated to 485° C. at a rate of 4.25° C./minute and maintained at 485° C. for 2 hours. After two hours of delayed coking, the system was shut down, cooled to room temperature and any volatiles, i.e., C1-C4 gases and light materials, were purged from the system. The liquid and solid products were separated, with a yield of 34 W % of coke, based on the weight of starting material.

Example 2

The same atmospheric residue used in Example 1 was subjected to delayed coking in an autoclave. The atmospheric residue was placed in the autoclave and pressurized with hydrogen gas at 60 bars. The vessel was then heated to 375° C. at a rate of for 4.25° C./minute and was then depressurized to atmospheric pressure to remove any volatiles including gas phase hydrogen from the system. The heating continued at the same rate to a temperature of 485° C. The temperature was kept at 485° C. for 2 hours, after which the system was shut-down, cooled to room temperature and any volatiles, i.e., C1-C4 gases and any light materials, were purged from the system. The liquid and solid products were separated with a yield of 29 W % of coke. The hydrogen dissolved in the system lowered the coke production by 5 W %.

Example 3

The same atmospheric residue used in Example 1 was subjected to delayed coking in an autoclave. The atmospheric residue was placed in the autoclave and pressurized with hydrogen gas at 60 bars. The vessel was then heated to 375° C. at a rate of for 4.25° C./minute and then depressurized to 3 bars of pressure to remove any volatiles from the system while retaining some hydrogen in the system. The heating continued at the same rate to a temperature of 485° C. and was maintained at 485° C. for 2 hours, after which the system was shut-down, cooled to room temperature and any volatiles, i.e., C1-C4 gases and any light materials, were purged from the system. The liquid and solid products were separated with a yield of 29 W % of coke. The hydrogen dissolved in the system and/or remaining in the gas phase lowered the coke production by 5 W %.

The reduction in the coke yield in Examples 2 and 3 indicate that the hydrogen dissolved in the atmospheric residue inhibited to some extent the undesirable polymerization reactions.

Although the present invention has been described with reference to various examples and embodiments, other modifications and variations will be apparent to those of ordinary skill in the art from the above description, and the scope of protection for the invention is to be determined by the claims that follow.

The invention claimed is:

1. A method of treating a hydrocarbon oil feedstream to a delayed coking unit to maximize the ratio of yield of liquids-to-light gases, and to minimize formation of coke, the method characterized by:

a. mixing an oil-soluble catalyst with the hydrocarbon oil feedstream to provide a uniform mixture;

b. contacting the uniform mixture with an excess of hydrogen under predetermined conditions of temperature and pressure that are favorable to maximizing the solubility of the hydrogen in the feedstream in a hydrogen distribution zone that is upstream of the delayed coking unit;

c. introducing the feedstream containing the solubilized catalyst and dissolved hydrogen, and the excess hydrogen gas into a flashing zone;

d. recovering from the flashing zone a hydrogen gas stream and a single-phase hydrocarbon oil feedstream containing dissolved hydrogen and catalyst;

e. maintaining the hydrocarbon oil feedstream containing dissolved hydrogen and catalyst under single-phase conditions to promote reaction of the dissolved hydrogen with free radicals formed in the feedstream and to promote catalyzed hydrodesulfurization of any sulfur-containing compounds present in the feedstream;

f. introducing the catalyst and dissolved hydrogen-containing feedstream into a coking unit furnace upstream of the coking unit to heat the feedstream to a predetermined coking temperature;

g. introducing the catalyst and dissolved hydrogen-containing feedstream that is heated to the predetermined coking temperature into a drum of the coking unit; and h. recovering a coking unit product stream that is free of catalyst and forming a coke product that contains the catalyst in the coking unit drum.

2. The method of claim 1 in which the oil-soluble catalyst is first solubilized in a diluent hydrocarbon oil that is lighter than the feedstream that is to be treated before it is added to the hydrocarbon oil feedstream.

3. The method of claim 2 in which the hydrocarbon oil is added to the catalyst and diluent oil mixture while the addition of hydrogen is continued until the mixed solution is saturated with hydrogen.

4. The method of claim 2 in which the diluent oil containing the catalyst is contacted with an excess of hydrogen before the catalyst and diluent oil are added to the hydrocarbon oil feedstream.

5. The method of claim 4 in which the hydrogen is introduced into the diluent oil containing catalyst at a pressure in the range of from 1 to 60 bar.

6. The method of claim 1 in which the hydrocarbon oil feedstream comprises bottoms recovered from an initial fractionation step to reduce light hydrocarbons in a fresh hydrocarbon oil feedstream.

7. The method of claim 1 in which the oil-soluble catalyst is an organometal complex selected from the group consisting of compounds containing metals from the elements of IUPAC groups 4-12 of the Periodic Table, and combinations thereof.

8. The method of claim 7 in which the metals are selected from the group consisting of Mo, Fe, Ni, Co, W, and combinations thereof.

9. The method of claim 1 in which the hydrogen is introduced into the hydrocarbon oil feed stream at a pressure in the range of from 1 to 60 bar.

10. The method of claim 1 in which the hydrogen is contacted with the catalyst-containing hydrocarbon oil feedstream at a gaseous hydrogen-to-oil volumetric ratio that ranges from 10-to-1 to 5000-to-1.

11. The method of claim 1 in which the temperature of the uniform mixture is less than the temperature of the catalyst and dissolved hydrogen containing feedstream that is heat to the predetermined coking temperature.

12. The method of claim 11 in which the temperature of the catalyst and dissolved hydrogen containing feedstream that is heated to the predetermined temperature is in the range of from 425° C. to 650° C.

13. The method of claim 1 in which the pressure of the hydrogen gas in the flashing zone is in the range of from 1 to 60 bar.

14. The method of claim 1 wherein the catalyst is dissolved in the hydrocarbon oil feedstream in an amount in the range of 1 ppm to 5000 ppm by weight of a metal component of the catalyst to the hydrocarbon oil feedstream.

15. The method of claim 1 in which the molal amount of the hydrogen dissolved in the hydrocarbon oil feedstream recovered from the flashing zone is approximately one-third of the hydrogen originally contacting the hydrocarbon oil feedstream.

16. The method of claim 1 in which the hydrocarbon oil feedstream is selected from the group consisting of crude oil, bitumen, tar sands, coal liquid, bio derived oil, and shale oil, residual oil bottoms from atmospheric distillation and vacuum distillation, coking heavy oil products, visbreaker and FCC bottoms, and mixtures thereof.

17. The method of claim 16 in which the coking unit product stream is introduced into a coking unit product fractionator and a portion of fractionator bottoms are mixed as a fractionator recycle stream with the hydrocarbon oil feed stream.

18. The method of claim 17 in which at least a portion of the hydrocarbon oil feedstream is introduced into the coking unit product fractionator for mixing with the fractionator bottoms.

19. The method of claim 1 in which the oil-soluble catalyst is mixed with a diluent hydrocarbon oil and the diluent oil/catalyst mixture is added to the feedstream.

20. The method of claim 19 in which the diluent oil is selected from the group consisting of vacuum gas oil, decant oil, cycle oil, light gas oil, and mixtures thereof.

21. The method of claim 19 in which the diluent oil is recovered from a coking unit product stream fractionator.

22. A method of treating a hydrocarbon oil feedstream to a delayed coking unit to maximize the ratio of yield of liquids-to-light gases, and to minimize formation of coke, the method characterized by:

a. mixing an oil-soluble catalyst with the hydrocarbon oil feedstream to provide a uniform mixture, wherein the oil-soluble catalyst is an organometal complex selected from the group consisting of compounds containing metals from the elements of IUPAC groups 4-12 of the Periodic Table, and combinations thereof;

b. contacting the uniform mixture with a predetermined amount of hydrogen from a source of pressurized hydrogen under predetermined conditions of temperature and pressure to saturate the feedstream with the hydrogen in a hydrogen distribution zone that is upstream of the delayed coking unit, wherein the hydrogen distribution zone comprises a mixing column or vessel having a plurality of manifolds each connected to the source of pressurized hydrogen, and wherein each of the manifolds comprise spaced-apart nozzles, jets or orifices, wherein hydrogen is discharged through the nozzles, jets or orifices, and creates zones of turbulence that promote absorption of hydrogen in the feedstream to form a single-phase hydrocarbon oil feedstream containing dissolved hydrogen and catalyst;

c. recovering from the hydrogen distribution zone a-the single-phase hydrocarbon oil feedstream containing dissolved hydrogen and catalyst;

d. maintaining the hydrocarbon oil feedstream containing dissolved hydrogen and catalyst under single-phase conditions to promote reaction of the dissolved hydrogen with free radicals formed in the feedstream and to promote catalyzed hydrodesulfurization of any sulfur-containing compounds present in the feedstream;

e. introducing the catalyst and dissolved hydrogen-containing feedstream into a coking unit furnace upstream of the coking unit to heat the feedstream to a predetermined coking temperature;

f. introducing the catalyst and dissolved hydrogen-containing feedstream that is heated to the predetermined coking temperature into the coking unit; and g. recovering a coking unit product stream that is free of catalyst and forming a coke product that contains the catalyst.

23. A method of treating a hydrocarbon oil feedstream to a delayed coking unit to maximize the ratio of yield of liquids-to-light gases, and to minimize formation of coke, the method characterized by:

a. contacting the hydrocarbon oil feedstream with an excess of hydrogen under predetermined conditions that are favorable to maximizing the solubility of the hydrogen in the feed stream in a hydrogen distribution zone that is upstream of the delayed coking unit;

b. introducing the feedstream containing the dissolved hydrogen and the excess hydrogen gas into a flashing zone;

c. recovering from the flashing zone a hydrogen gas stream and a single-phase hydrocarbon oil feedstream containing dissolved hydrogen;

d. heating the hydrocarbon oil feedstream containing dissolved hydrogen under temperature and pressure conditions to maintain a single-phase to promote reaction of the dissolved hydrogen with free radicals formed in the feedstream by thermal cracking;

e. introducing the feedstream, hydrogenated reaction products and any remaining dissolved hydrogen into a coking furnace upstream of the coking unit to heat the feedstream to a predetermined coking temperature;

f. introducing the feedstream that is heated to a predetermined coking temperature from the coking furnace into the coking unit; and g. recovering a coking unit product stream having a reduced amount of heavy polymerized hydrocarbon molecules as compared to a feedstream not containing dissolved hydrogen.

* * * * *